US010426279B2

(12) United States Patent
Ibrahim

(10) Patent No.: US 10,426,279 B2
(45) Date of Patent: Oct. 1, 2019

(54) BOLSTER PILLOW

(71) Applicant: Zafar Ibrahim, Lakewood, WA (US)

(72) Inventor: Zafar Ibrahim, Lakewood, WA (US)

( * ) Notice: Subject to any disclaimer, the term of this patent is extended or adjusted under 35 U.S.C. 154(b) by 273 days.

(21) Appl. No.: 15/653,310

(22) Filed: Jul. 18, 2017

(65) Prior Publication Data

US 2018/0014667 A1 Jan. 18, 2018

Related U.S. Application Data

(60) Provisional application No. 62/363,374, filed on Jul. 18, 2016.

(51) Int. Cl.

| | |
|---|---|
| ***A47G 9/10*** | (2006.01) |
| ***A47G 9/02*** | (2006.01) |
| ***A47C 7/38*** | (2006.01) |

(52) U.S. Cl.

CPC ..... *A47G 9/10* (2013.01); *A47C 7/38* (2013.01); *A47G 9/0253* (2013.01); *A47G 2009/1018* (2013.01)

(58) Field of Classification Search

CPC ..... A47G 9/10; A47G 9/1009; A47G 2009/1018; A47G 9/1081; A47G 9/109; A47G 9/0253; A47C 7/38; A47C 7/383; A47D 13/00; A47D 13/08; A47D 13/083; A47D 15/00

USPC ..... 5/636, 630, 632, 643, 490, 655, 655.9, 5/652

See application file for complete search history.

(56) References Cited

U.S. PATENT DOCUMENTS

| | | | | |
|---|---|---|---|---|
| 1,211,257 A * | 1/1917 | Thomas | A47G 9/10 | 5/252 |
| 3,234,569 A * | 2/1966 | Stewart | A47G 9/10 | 5/636 |
| 3,378,860 A * | 4/1968 | Frazier | A47C 27/16 | 5/491 |
| 3,719,185 A * | 3/1973 | Hanes | A47G 9/10 | 5/630 |
| 3,802,704 A * | 4/1974 | Genua | A63B 67/06 | 206/315.1 |
| 3,842,453 A * | 10/1974 | Redfield | A47G 9/10 | 5/491 |
| 4,081,870 A * | 4/1978 | Iannucci | A47G 9/10 | 297/DIG. 1 |
| 4,761,872 A * | 8/1988 | Buettner | A47G 9/10 | 29/235 |

(Continued)

*Primary Examiner* — Robert G Santos

(57) ABSTRACT

A bolster pillow which provides adequate support, without deforming or collapsing, to a user while being lightweight and commercially viable. The bolster pillow includes an internal rigid tube, a cushioned sleeve, an internal cover, and an external cover. The internal rigid tube acts as the structural support element to ensure the overall shape of the bolster pillow and does not change regardless of the number of uses. The internal sleeve envelops the internal rigid tube and extends from a first end to a second end of the internal rigid tube. The cushioned sleeve adds padding to the bolster pillow for increased comfort. The cushioned sleeve is concentrically positioned with the internal rigid tube and is positioned about the internal cover, opposite the internal rigid tube. The external cover tensionably envelops the internal rigid tube, the internal cover, and the cushioned sleeve.

13 Claims, 4 Drawing Sheets

(56) References Cited

U.S. PATENT DOCUMENTS 5,371,909 A * 12/1994 McCarty ..... A47D 13/08 5/490
5,545,199 A * 8/1996 Hudson ..... A47G 9/1036 5/421
5,675,850 A * 10/1997 Schmitt ..... A61H 7/001 128/845
5,740,571 A * 4/1998 Tyra ..... A47C 20/022 5/624
5,824,013 A * 10/1998 Allen ..... A47C 7/425 606/240
6,360,388 B2 * 3/2002 Langer ..... A61G 7/0755 5/490
6,449,788 B1 * 9/2002 Nichols ..... A47C 20/021 5/630
6,481,032 B2 * 11/2002 Milano ..... A47D 15/008 5/632
6,708,353 B2 * 3/2004 Han ..... A47C 20/023 5/630
6,990,699 B2 * 1/2006 Hedges ..... A47G 9/1081 128/845
7,108,646 B1 * 9/2006 Quick ..... A47D 13/08 482/132
7,185,378 B2 * 3/2007 Smith ..... A45C 13/26 128/DIG. 23
7,998,031 B2 * 8/2011 Dumke ..... A63B 21/0084 441/129
8,672,818 B2 * 3/2014 Welch ..... A63B 21/0724 482/132
8,708,416 B2 * 4/2014 Stronconi ..... A47C 20/02 297/397
9,005,146 B2 * 4/2015 Phillips ..... A61H 15/0092 482/132
9,044,373 B2 * 6/2015 Welch ..... A63B 21/0724
9,101,235 B2 * 8/2015 Yu ..... A47G 9/1081
9,821,185 B2 * 11/2017 Welch ..... A63B 21/0724
10,010,183 B2 * 7/2018 DeMore ..... A47G 9/109
2001/0009043 A1 * 7/2001 Langer ..... A61G 7/0755 5/632
2002/0020021 A1 * 2/2002 Milano ..... A47D 15/008 5/655
2003/0126684 A1 * 7/2003 Han ..... A47C 20/023 5/630
2004/0039316 A1 * 2/2004 Smith ..... A45C 13/26 602/6
2005/0198738 A1 * 9/2005 Hedges ..... A47G 9/1081 5/636
2008/0081742 A1 * 4/2008 Dumke ..... A63B 21/0084 482/55
2011/0263391 A1 * 10/2011 Welch ..... A63B 21/0724 482/93
2012/0065557 A1 * 3/2012 Phillips ..... A61H 15/0092 601/99
2013/0119716 A1 * 5/2013 Stronconi ..... A47C 20/02 297/180.1
2014/0148852 A1 * 5/2014 Welch ..... A63B 21/0724 606/237
2015/0096124 A1 * 4/2015 Yu ..... A47G 9/1081 5/640
2015/0246257 A1 * 9/2015 Welch ..... A63B 21/0724 482/93
2017/0303689 A1 * 10/2017 DeMore ..... A47G 9/109
2018/0014667 A1 * 1/2018 Ibrahim ..... A47G 9/10
2018/0064253 A1 * 3/2018 DeMore ..... A47G 9/109

* cited by examiner

BOLSTER PILLOW

The current application claims a priority to the U.S. Provisional Patent application Ser. No. 62/363,374 filed on Jul. 18, 2016.

FIELD OF THE INVENTION

The present invention relates generally to support pillows. More specifically, the present invention is a bolster pillow with a rigid internal foundation designed to provide firm support without deforming or collapsing.

BACKGROUND OF THE INVENTION

A bolster pillow is a long and thick pillow that is used to provide support, either by itself or under other pillows. The bolster pillow is popular for providing support to the back region of a user, thus propping up the user into a more vertical and comfortable orientation. Additionally, the bolster pillow is often used for rehabilitation purposes. In particular, the bolster pillow is used to elevate the legs or hands of the user to aid in healing processes. Traditional bolster pillows are versatile and have a variety of different uses but lack durability. The majority of bolster pillows deform and collapse after being used for a certain amount of time, thus reducing the support provided to the user. This is the result of the bolster pillow being built with no internal support structure. Thus, there is a need for a bolster pillow capable of providing support throughout its lifetime.

The present invention provides a reliable and firm bolster pillow. The present invention utilizes an internal support structure which prevents deformation and collapsing when exposed to various pressure associated with use and extended use. Additionally, the design of the present invention is innovative and commercially viable.

DETAIL DESCRIPTIONS OF THE INVENTION

All illustrations of the drawings are for the purpose of describing selected versions of the present invention and are not intended to limit the scope of the present invention.

The present invention relates to support pillows and cushions. More specifically, the present invention is a bolster pillow which provides a firm and rigid support without deforming or collapsing from extended use. Additionally, the present invention is light weight, thus leading to overall lower travel and transportation weight.

Figure 1:
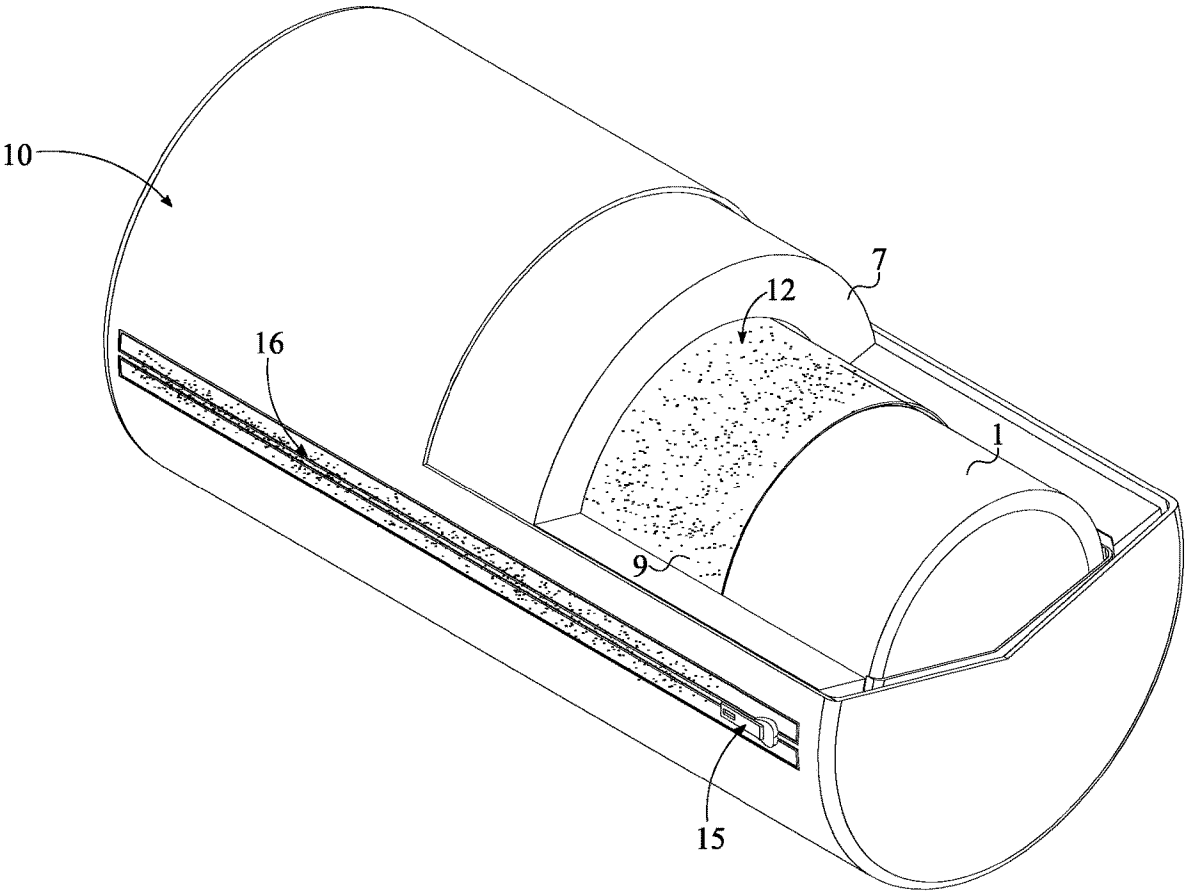
FIG. 1 is a perspective semi-internal view of the present invention, without a removable cover sleeve

Referring to FIG. 1, the present invention comprises an internal rigid tube 1, a cushioned sleeve 7, an internal cover 9, and an external cover 10. The internal rigid tube 1 is an elongated cylinder with a central cavity running along the cylinder. The preferred cross-section of the internal rigid tube 1 is a circular cross-section to ensure equal pressure is applied onto a user leaning or lying on the present invention. The internal rigid tube 1 is preferably composed of a rigid and inflexible material such as hard plastic to ensure product longevity. The internal cover 9 is a piece of fabric sized complimentary to the external dimensions of the internal rigid tube 1 and provides protection to the internal rigid tube 1. More specifically, the internal cover 9 envelopes the internal rigid tube 1, extending from a first end 2 of the internal rigid tube 1 to a second end 3 of the internal rigid tube 1. Additionally, the internal cover 9 acts as an intermediate component for mounting the cushioned sleeve 7 to the internal rigid tube 1. The cushioned sleeve 7 provides padding for the user. This ensures that the user experiences rigid, even, and comfortable support. The cushioned sleeve 7 is preferably composed of a foam material that is tubular shaped and is sized complimentary to the internal rigid tube 1. Although, alternative materials with similar characteristics may also be utilized for the cushioned sleeve 7. The cushioned sleeve 7 is concentrically positioned with the internal rigid tube 1. Additionally, the cushioned sleeve 7 is positioned about and attached to the internal cover 9, opposite the internal rigid tube 1. In other words, the internal rigid tube 1 and the internal cover 9 are sleeved by the cushioned sleeve 7 as seen in FIG. 1. It is preferred that an adhesive layer 12 is used to attach the cushioned sleeve 7 to the internal cover 9. In particular, the adhesive layer 12 is positioned in between the cushioned sleeve 7 and internal cover 9, thus attaching the cushioned sleeve 7 to the internal cover 9.

Figure 3:
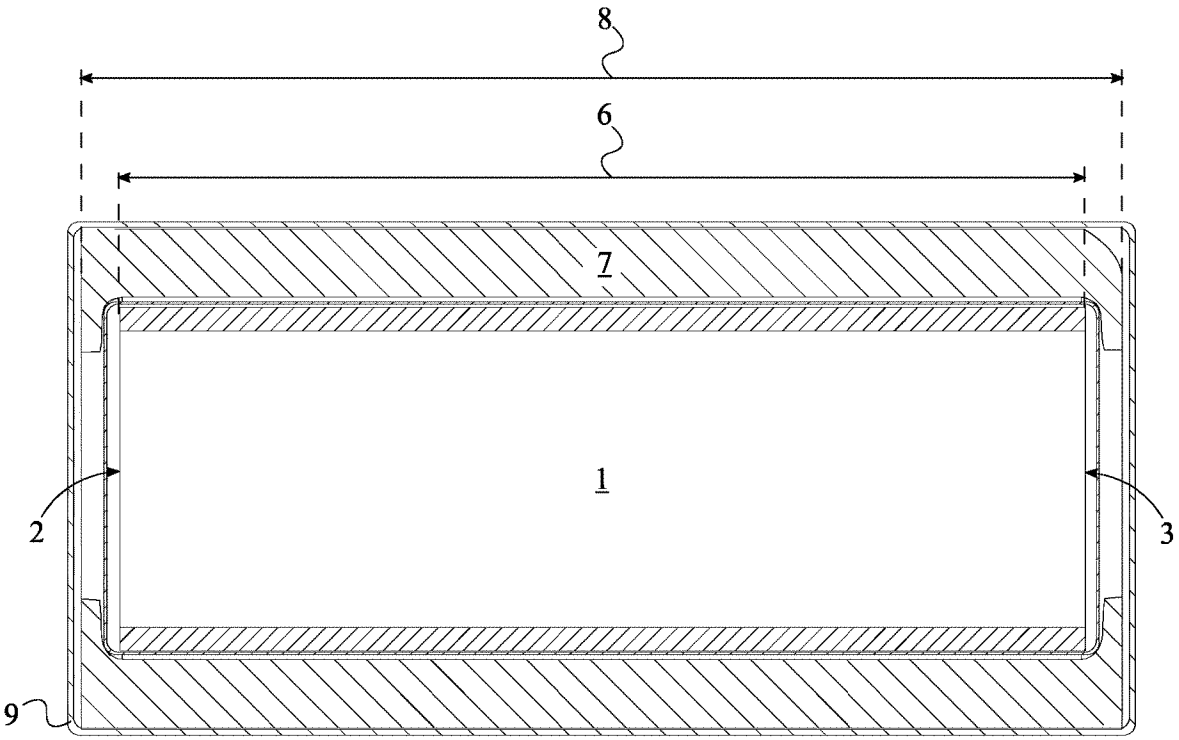
FIG. 3 is a cross-sectional view of the present invention without the removable cover sleeve.

Referring to FIG. 1 and FIG. 3, to protect the cushioned sleeve 7 from wear and tear, the external cover 10 is used. The external cover 10 is piece of fabric which tensionably envelopes the internal rigid tube 1, the internal cover 9 and the cushioned sleeve 7. The external cover 10 keeps the aforementioned components together. Additionally, the external cover 10 encloses the first end 2 and the second end 3 of the internal rigid tube 1, thus preventing any substances from entering the inner area of the internal rigid tube 1 that could damage the overall structural integrity of the present invention. It is further preferred that a length 8 of the cushioned sleeve 7 is greater than a length 6 of the internal rigid tube 1. Thus, when the external cover 10 envelops the cushioned sleeve 7, both ends of the cushioned sleeve 7 are pushed inwards towards the center of the internal rigid tube 1. This positions a portion of the cushioned sleeve 7 over the rim and edge of the first end 2 and the second end 3 of the internal rigid tube 1. Resultantly, padding is added to the first end 2 and the second end 3 such that a user is not hurt if he or she laterally leans on the present invention.

Figure 4:
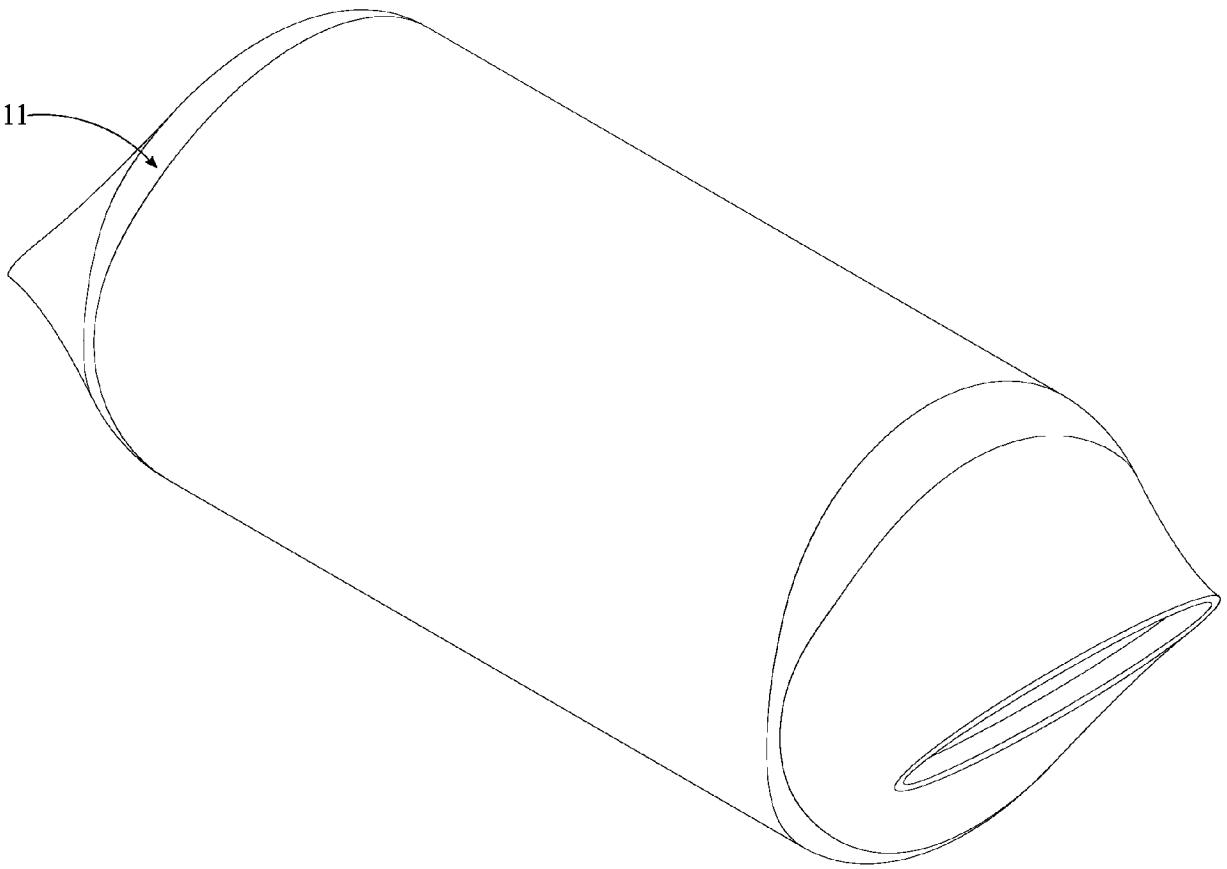
FIG. 4 is perspective view of the present invention.

Referring to FIG. 4, in the preferred embodiment of the present invention, the present invention further comprises a removable cover sleeve 11. The removable cover sleeve 11 is a piece of fabric with a tubular shape. The removable cover sleeve 11 is sized to receive the internal rigid tube 1, the internal cover 9, the cushioned sleeve 7, and the external cover 10. In general, the removable cover sleeve 11 acts similar to a pillow case. As such, the removable cover is composed of washable fabric. Although alternative material composition may also be used such as leather. The washable quality allows the user to remove stains from the present invention. To put on the removable cover sleeve 11, the removable cover sleeve 11 is first positioned concentric with the internal rigid tube 1 and then slid over the external cover 10 until the removable cover sleeve 11 is tensionably positioned about the external cover 10, opposite the cushioned sleeve 7.

In the preferred embodiment of the present invention, the internal rigid tube 1 is designed specifically to endure extreme uses and remain un-collapsed. Because the present invention is designed to be used as a support device for portions of the user's body, the present invention must be able to withstand a significant amount of pressure over long periods of time. In particular, the internal rigid tube 1 has a smooth surface without any protrusions, such that equal pressure and support is provided to the user. The internal ridged tube 1 is the most light means for providing cylindrical support. This design ensures adequate structural integrity while also providing the user with an overall lightweight device.

In alternative embodiments of the present invention, the internal rigid tube 1 is an elongated tube composed of rigid material such as plastic, wood, metal, and other materials with similar structural characteristics and weight considerations.

Figure 2:
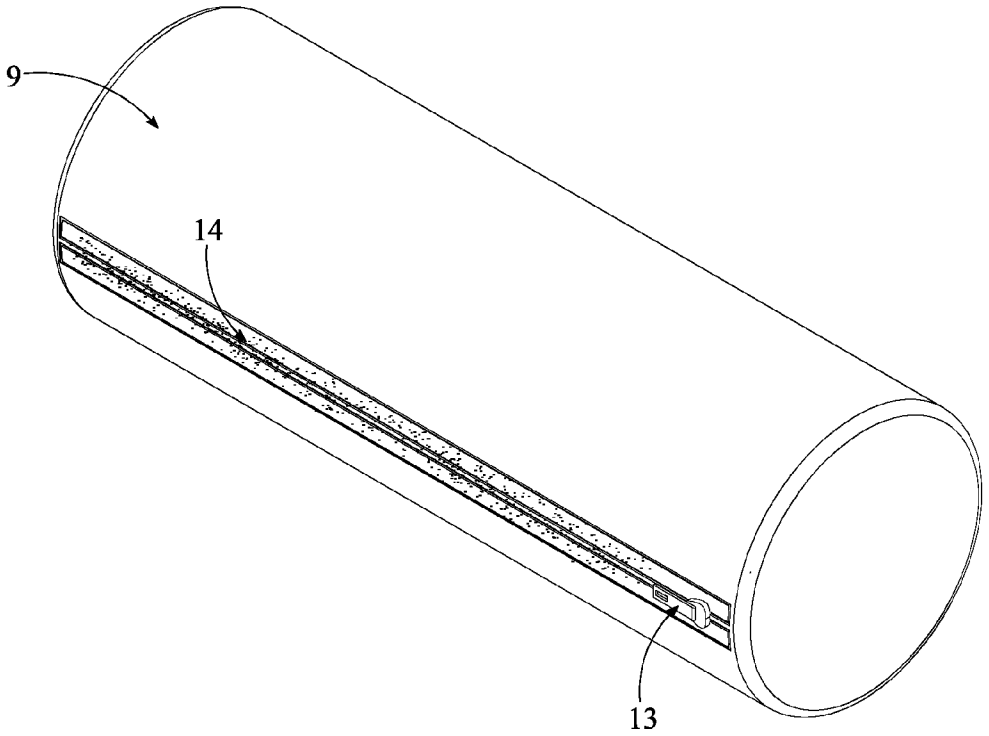
FIG. 2 is a perspective view of an internal cover without an adhesive layer, depicting a first zipper and a first adhesive sealant.

In one embodiment, referring to FIG. 1 and FIG. 2, the present invention utilizes a novel design which provides an inexpensive and commercially viable manufacturing process. In particular, in this embodiment the present invention further comprises a first zipper 13, a first adhesive sealant 14, a second zipper 15, and a second adhesive sealant 16. The first zipper 13 is positioned along the internal cover 9 and is mechanically integrated into the internal cover 9. The first zipper 13 provides an opening in the internal cover 9 which receives the internal rigid tube 1. Similarly, the second zipper 15 is positioned along the external cover 10 and is mechanically integrated into the external cover 10. The second zipper 15 provides an opening in the external cover 10 which receives the internal rigid tube 1, the internal cover 9, and the cushioned sleeve 7.

The first step in the manufacturing process includes enveloping the internal rigid tube 1 by the internal cover 9. For this, the internal rigid tube 1 traverses through the first opening until the internal rigid tube 1 is fully enveloped by the internal cover 9. Next, the first zipper 13 is positioned into the closed configuration and fastened shut. In particular, the first adhesive sealant 14 is applied onto and along the first zipper 13 and left to dry and harden. The next major step in the manufacturing process includes attaching the cushioned sleeve 7 over the internal cover 9 and the internal rigid tube 1. This process includes first applying the adhesive layer 12 onto the internal cover 9. Then, the cushioned sleeve 7 is slid over the internal cover 9 such that a portion of the cushioned sleeve 7 extends past the first end 2 and the second end 3 of the internal rigid tube 1.

Afterwards, a similar process is used to attach the external cover 10. The cushioned sleeve 7, the internal cover 9, and the internal rigid tube 1 are pushed into the opening of the external cover 10. Once the cushioned sleeve 7, the internal cover 9, and the internal rigid tube 1 are positioned within the external cover 10, the second zipper 15 is fastened closed by the second adhesive sealant 16. In particular, the second adhesive sealant 16 is applied onto and along the second zipper 15 until and left to dry and harden. The final step includes sliding the removable cover sleeve 11 over the external cover 10, the cushioned sleeve 7, the internal cover 9, and the internal rigid tube 1.

Although the invention has been explained in relation to its preferred embodiment, it is to be understood that many other possible modifications and variations can be made without departing from the spirit and scope of the invention as hereinafter claimed.

What is claimed is:

1. A bolster pillow comprises:
an internal rigid tube;
a cushioned sleeve;
an internal cover;
an external cover;
the internal rigid tube being enveloped by the internal cover;
the internal cover extending from a first end of the internal rigid tube to a second end of the internal rigid tube;
the cushioned sleeve being concentrically positioned with the internal rigid tube;
the cushioned sleeve being positioned about the internal cover, opposite the internal rigid tube;
the cushioned sleeve being attached to the internal cover; and
the internal rigid tube, the internal cover, and the cushioned sleeve being tensionably enveloped by the external cover.

2. The bolster pillow as claimed in claim 1 comprises:
a removable cover sleeve;
the removable cover sleeve being positioned concentric with the internal rigid tube; and
the removable cover sleeve being tensionably positioned about the external cover, opposite the cushioned sleeve.

3. The bolster pillow as claimed in claim 1, wherein the cushioned sleeve is composed of a foam material.

4. The bolster pillow as claimed in claim 1 comprises:
an adhesive layer;
the adhesive layer being positioned in between the cushioned sleeve and the internal cover; and
the cushioned sleeve being attached to the internal cover by the adhesive layer.

5. The bolster pillow as claimed in claim 1, wherein a length of the cushioned sleeve is greater than a length of the internal rigid tube.

6. The bolster pillow as claimed in claim 1 comprises:
a first zipper;
a first adhesive sealant;
the first zipper being positioned along the internal cover;
the first zipper being mechanically integrated into the internal cover; and
the first adhesive sealant being applied onto and along the first zipper.

7. The bolster pillow as claimed in claim 1 comprises:
a second zipper;
a second adhesive sealant;
the second zipper being positioned along the external cover;
the second zipper being mechanically integrated into the external cover; and
the second adhesive sealant being applied onto and along the second zipper.

8. A bolster pillow comprises:
an internal rigid tube;
a cushioned sleeve;
an internal cover;
an external cover;
a removable cover sleeve;
the internal rigid tube being enveloped by the internal cover;
the internal cover extending from a first end of the internal rigid tube to a second end of the internal rigid tube;
the cushioned sleeve being concentrically positioned with the internal rigid tube;
the cushioned sleeve being positioned about the internal cover, opposite the internal rigid tube;
the cushioned sleeve being attached to the internal cover;
the internal rigid tube, the internal cover, and the cushioned sleeve being tensionably enveloped by the external cover;

the removable cover sleeve being positioned concentric with the internal rigid tube; and the removable cover sleeve being tensionably positioned about the external cover, opposite the cushioned sleeve.

9. The bolster pillow as claimed in claim 8, wherein the cushioned sleeve is composed of a foam material.

10. The bolster pillow as claimed in claim 8 comprises:

an adhesive layer;

the adhesive layer being positioned in between the cushioned sleeve and the internal cover; and the cushioned sleeve being attached to the internal cover by the adhesive layer.

11. The bolster pillow as claimed in claim 8, wherein a length of the cushioned sleeve is greater than a length of the internal rigid tube.

12. The bolster pillow as claimed in claim 8 comprises:

a first zipper;

a first adhesive sealant;

the first zipper being positioned along the internal cover;

the first zipper being mechanically integrated into the internal cover; and the first adhesive sealant being applied onto and along the first zipper.

13. The bolster pillow as claimed in claim 8 comprises:

a second zipper;

a second adhesive sealant;

the second zipper being positioned along the external cover;

the second zipper being mechanically integrated into the external cover; and the second adhesive sealant being applied onto and along the second zipper.

* * * * *